US006507135B1

(12) United States Patent
Winkler

(10) Patent No.: US 6,507,135 B1
(45) Date of Patent: Jan. 14, 2003

(54) AXIAL VENTILATOR WITH EXTERNAL-ROTOR DRIVE MOTOR

(75) Inventor: Wolfgang Arno Winkler, St. Georgen (DE)

(73) Assignee: Papst-Motoren GmbH & Co. KG, St. Georgen (DE)

( * ) Notice: Subject to any disclaimer, the term of this patent is extended or adjusted under 35 U.S.C. 154(b) by 0 days.

(21) Appl. No.: 09/763,719

(22) PCT Filed: Aug. 25, 1999

(86) PCT No.: PCT/EP99/06230

§ 371 (c)(1),
(2), (4) Date: Feb. 23, 2001

(87) PCT Pub. No.: WO00/13294

PCT Pub. Date: Mar. 9, 2000

(30) Foreign Application Priority Data

Sep. 1, 1998 (DE) ..... 298 15 682

(51) Int. Cl.[7] ..... H02K 5/167; F16C 27/08

(52) U.S. Cl. ..... 310/91; 310/90; 310/67 R; 310/51; 384/425

(58) Field of Search ..... 310/90, 91, 67 R, 310/51; 384/425, 427

(56) References Cited

U.S. PATENT DOCUMENTS 2,829,288 A * 4/1958 Scaheffer ..... 310/87
3,513,339 A * 5/1970 Harris et al. ..... 310/265
3,644,066 A * 2/1972 Heob et al. ..... 29/889
3,705,752 A * 12/1972 Ott et al. ..... 310/90
3,720,852 A * 3/1973 Vieweg et al. ..... 310/40 MM
3,749,457 A * 7/1973 Latussek et al. ..... 384/223
3,922,041 A * 11/1975 Quaile et al. ..... 368/324
3,935,489 A * 1/1976 Church et al. ..... 310/90
4,452,541 A * 6/1984 Carpenter ..... 384/223
4,519,010 A * 5/1985 Elsaesser et al. ..... 310/268
4,955,791 A * 9/1990 Wrobel ..... 310/67 R

FOREIGN PATENT DOCUMENTS

EP 766370 * 4/1997 ..... H02K/29/08

OTHER PUBLICATIONS

Abstract JP 7–147761, Takahashi, Jun. 6, 1995.*
Abstract JP 9–233738, Shinohara, Sep. 5, 1997.*

* cited by examiner

*Primary Examiner*—Burton S. Mullins
(74) *Attorney, Agent, or Firm*—Gudrun E. Huckett

(57) ABSTRACT

An axial ventilator has an external-rotor drive motor having an external rotor with a rotor shaft and an internal stator, wherein the external rotor rotates about the internal stator during operation of the external-rotor drive motor. A ventilator wheel driven by the external rotor is provided. A bearing support tube is arranged in the internal stator. A radial plain bearing is arranged in the bearing support tube and supports the rotor shaft. An axial bearing formed by a free end of the rotor shaft and a stationary counter member, against which the free end of the rotor shaft rests, are provided. The stationary counter member comprises a thrust element and an elastomeric shaped member. The thrust element is connected to the elastomeric shaped member. The elastomeric shaped member has a projection on a side facing the thrust element and the thrust element is axially supported on the projection, wherein the elastomeric shaped member is elastically deformable when impacts act on the thrust element in order to absorb, at least partially, the impacts.

28 Claims, 6 Drawing Sheets

AXIAL VENTILATOR WITH EXTERNAL-ROTOR DRIVE MOTOR

BACKGROUND OF THE INVENTION

1. Field of the Invention

The invention relates to an axial ventilator (axial fan) with an external-rotor drive motor, whose external rotor comprises a permanent magnet. External-rotor drive motors, for example, for driving axial ventilators, are known from European patent application 0 766 370 (EP198=EP-1011).

2. Description of Related Art

Should such a motor be subjected to impacts, a force acts on the rotor and moves it in the axial direction relative to the stator. Subsequently, the rotor moves back into its normal position relative to the stator. During this axial movement, it may happen that the rotor shaft impacts on the housing and then produces disturbing clattering noises.

SUMMARY OF THE INVENTION

It is therefore an object of the invention to provide a new axial ventilator.

According to the invention, this object is solved by an axial ventilator comprising an external-rotor drive motor whose external rotor provided with a rotor shaft drives a ventilator wheel and, in operation, rotates about an internal stator, wherein in the internal stator a bearing support tube is arranged in which a radial plain bearing is arranged which supports the shaft of the external rotor, and comprising an axial plain bearing which is provided between a free end of the rotor shaft and a stationary counter member, the latter comprising a thrust element which is supported on an elastomeric shaped member. By means of the elastomeric shaped member and the described configuration, the conduction of clattering noises into the ventilator housing is damped and reduced.

Another solution of the above object is characterized by a ventilator housing; a ventilator wheel cooperating with the ventilator housing; an external-rotor drive motor with an internal stator and an external rotor, with the ventilator wheel (36) being arranged on the latter; a rotor shaft for supporting the external rotor; a bearing support tube in which a radial plain bearing for the rotor shaft is arranged; an axial plain bearing for the rotor shaft which is provided between a free end of the rotor shaft and a stationary counter member, the latter comprising a thrust element for this free end of the rotor shaft, which thrust element is supported by an elastomeric shaped member which is arranged in a recess of the ventilator housing.

BRIEF DESCRIPTION OF THE DRAWINGS

Further details and advantageous developments of the invention result from the embodiments described in the following and illustrated in the drawing, which embodiments are not to be seen in any way as a limitation of the invention, as well as from the dependent claims. It is shown in:

DESCRIPTION OF THE PREFERRED EMBODIMENTS

Figure 2:
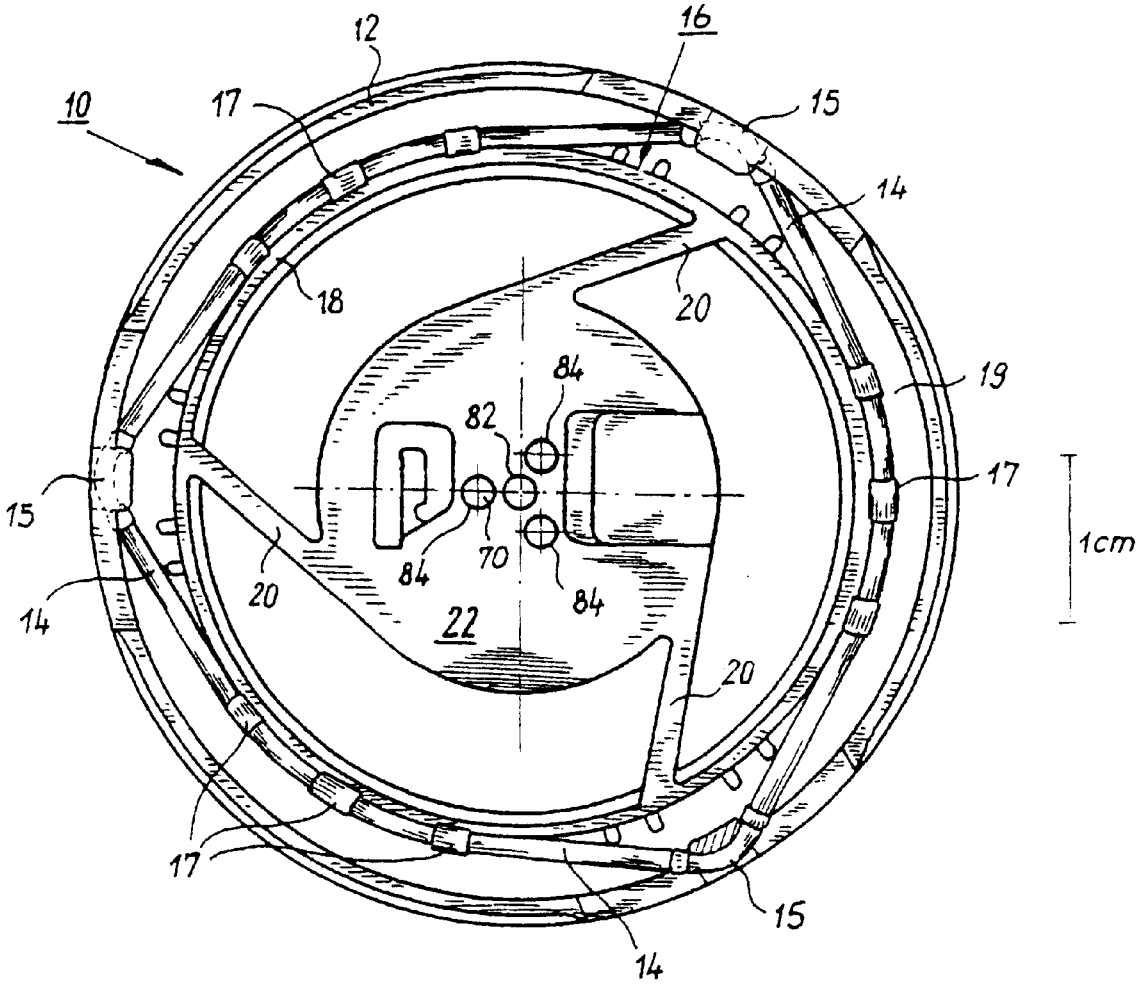
FIG. 2 a plan view onto the axial ventilator of FIG. 1, viewed in the direction of arrow II of FIG. 1.
Figure 3:
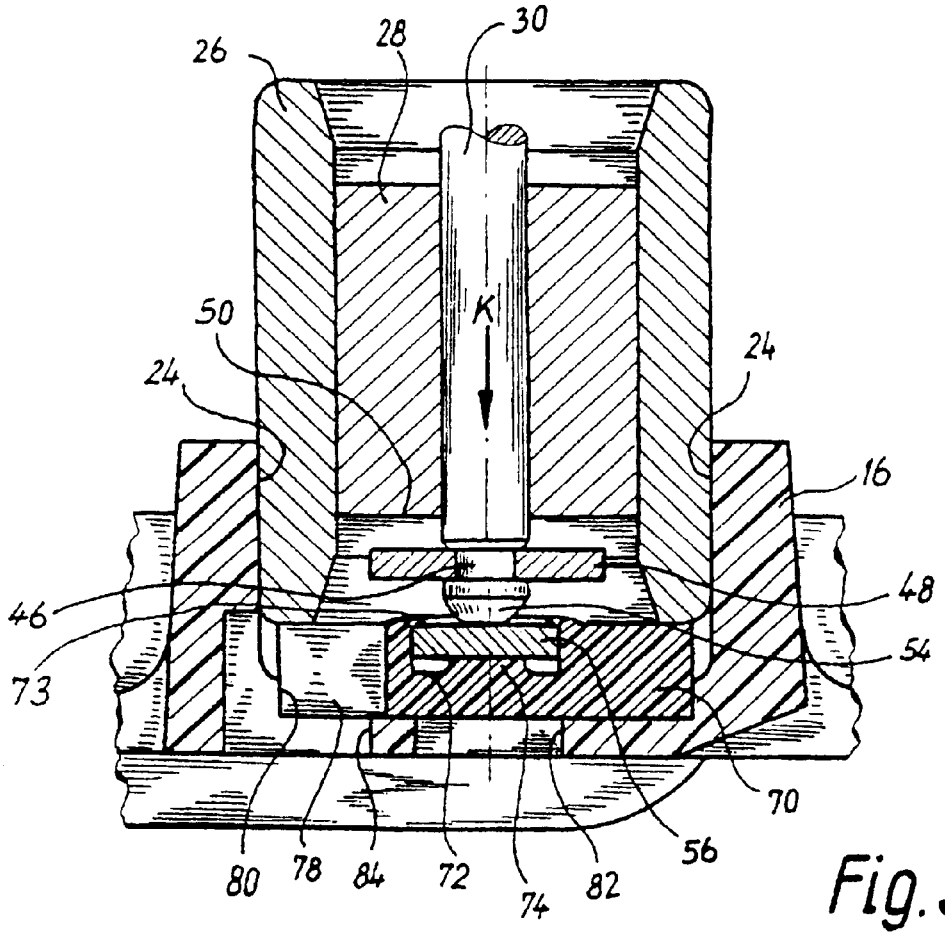
FIG. 3 a greatly enlarged detail of FIG. 1 with an elastomeric shaped member illustrated in FIG. 4, viewed along the line III—III of FIG. 4.

The invention is used primarily for very small ventilators, for example, those used in computers for cooling the processor or in vehicles for cooling vehicle parts. In FIG. 2, as an example, the length is given as 1 cm, in FIGS. 3 and 4 the length is 1 mm. On a scale of 1:1 details could not be illustrated so that enlarged illustrations must be used.

Figure 1:
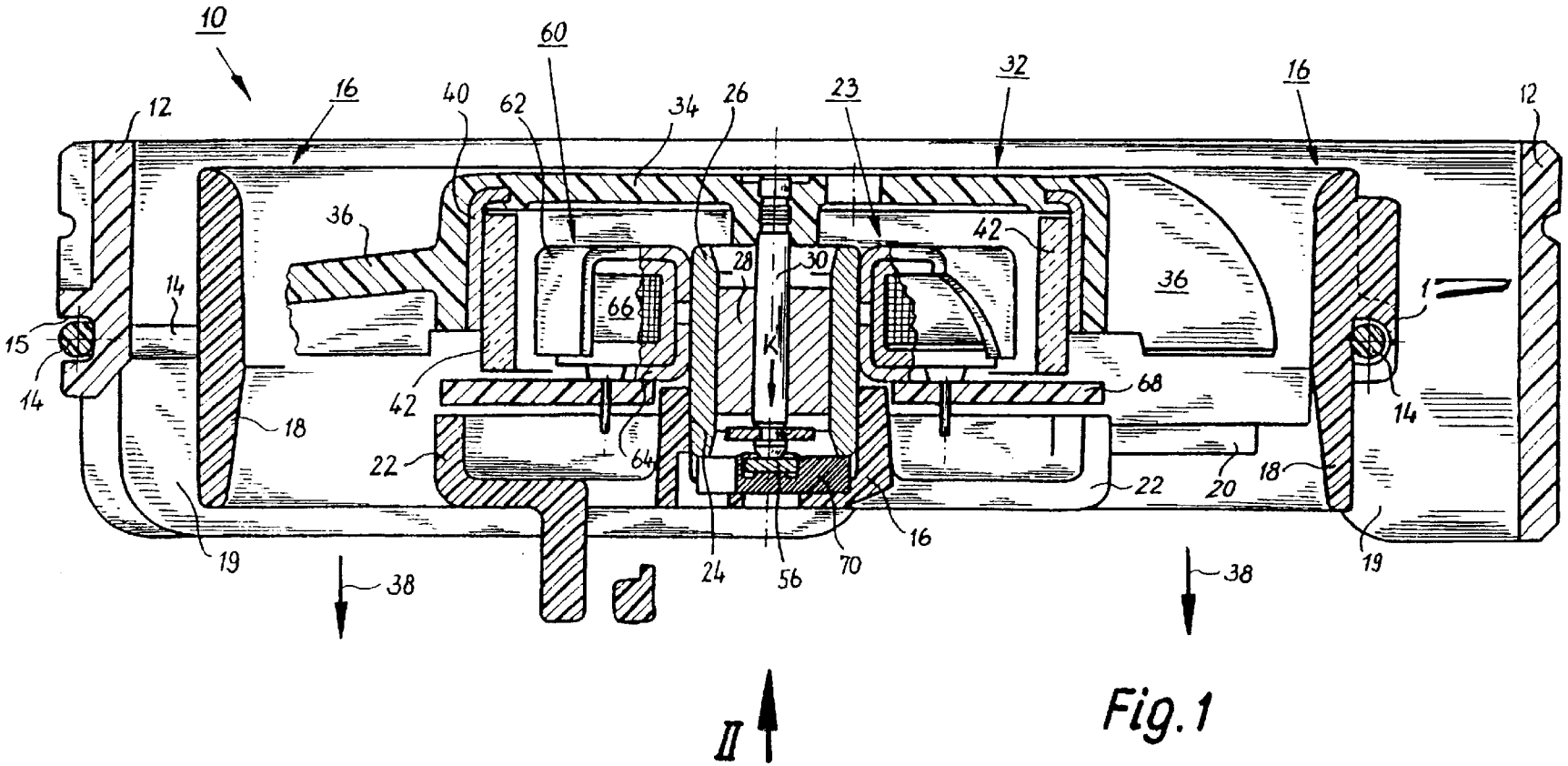
FIG. 1 a greatly enlarged longitudinal section of an axial ventilator according to the invention.

FIG. 1 shows a longitudinal section of an axial ventilator 10. It has an external ring 12 which is provided for mounting on a device (not illustrated) or the like. On the external ring 12, by means of a tensioned rubber band 14 which is provided for impact damping, a plastic ventilator housing 16 is elastically suspended in the way illustrated in order to reduce the further conduction of impacts and vibrations. For this purpose, the rubber band 14 has uniformly distributed suspending locations 15 on the external ring 12 and, staggered thereto, uniformly distributed fastening locations 17 on the ventilator housing 16. Between external ring 12 and air guiding ring 18 an intermediate space 19 is provided in order to ensure a free movability of the ventilator housing 16 in the external ring 12.

The ventilator housing 16 has an air guiding ring 18 at its periphery. A shell-shaped motor support part 22, which can also be called a motor flange and on which an electronically commutated motor 23 is arranged, is connected by means of three spokes 20 to the air guiding ring 18. The support part 22 has at its center a hollow-cylindrical receptacle 24 for a bearing support tube 26 in which a sinter bearing 28 is fastened by being pressed into it. The latter serves as a radial plain bearing for the shaft 30 of an external rotor 32 whose rotor cup 34 (of plastic material) is connected to the upper end of the shaft 30 in the way illustrated. On its periphery, the rotor cup 34 has ventilator vanes 36, which convey the air in the direction of arrows 38, i.e., downwardly in FIG. 1. This causes a reaction force acting on the external rotor 32 which acts in the upward direction, i.e., counter to the force K illustrated in FIGS. 1 and 3.

In the rotor cup 34 a magnetic return ring 40 of soft iron is fastened by injection molding and in it a rotor magnet 42 is fastened which is radially magnetized; see European patent application 0 766 370.

The lower end of the rotor shaft 30 in FIG. 1 has an annular groove 46 (FIG. 3) in which a securing disc 48 is fastened. The lafter has a minimal spacing of, for example, 0.2 mm, from the lower end 50 of the sinter bearing 28 and prevents thereby larger axial displacements of the rotor shaft 30, when great accelerations act on the ventilator 10.

Moreover, the rotor shaft 30 has at its free end a rounded portion 54 (FIG. 3) which can also be referred to as a track tip and which, as an axial plain bearing, rests against a thrust element 56 or 156 (FIGS. 8 to 10), for example, in the form of a thrust disc of polyamide, having added thereto molybdenum disulfide as a lubricant.

On the bearing support tube 26 a claw-field stator 60 is fastened in the illustrated manner which has two claw-field plates 62, 64 between which a coil 66 is located which surrounds the rotor shaft 30. For details on the configuration of the stator 60 see European patent application 0 766 370, also for the operation of the electronically commutated motor 23. On the lower end of the stator 60 a printed board 68 is fastened which supports electronic components for the motor (ECM) 23, for example, a Hall IC (not illustrated).

As illustrated in FIG. 1, the rotor magnet 42 is axially displaced upwardly relative to the field plates 62, 64, and this results in an axial magnetic force K on the rotor 32 in the downward direction because the motor 32 is pulled by the field plates in the downward direction. The force K presses the track tip 54 (FIG. 3) against the thrust disc 56.

The thrust disc 56 is secured in a shaped hollow 72 (FIG. 3) in the center of an elastomeric shaped member 70. This shaped hollow 72 has at its bottom a central projection 74 which can also be referred to as a base or pedestal and on which the bottom side of the thrust disc 56 rests; see FIG. 3. When an impact acts in the downward direction on the rotor 32, the base 74 is elastically compressed, essentially as a first line of defense, and dampens thus the impact. The top of the thrust disc 56 is secured by the annular bead 73.

Figure 4:
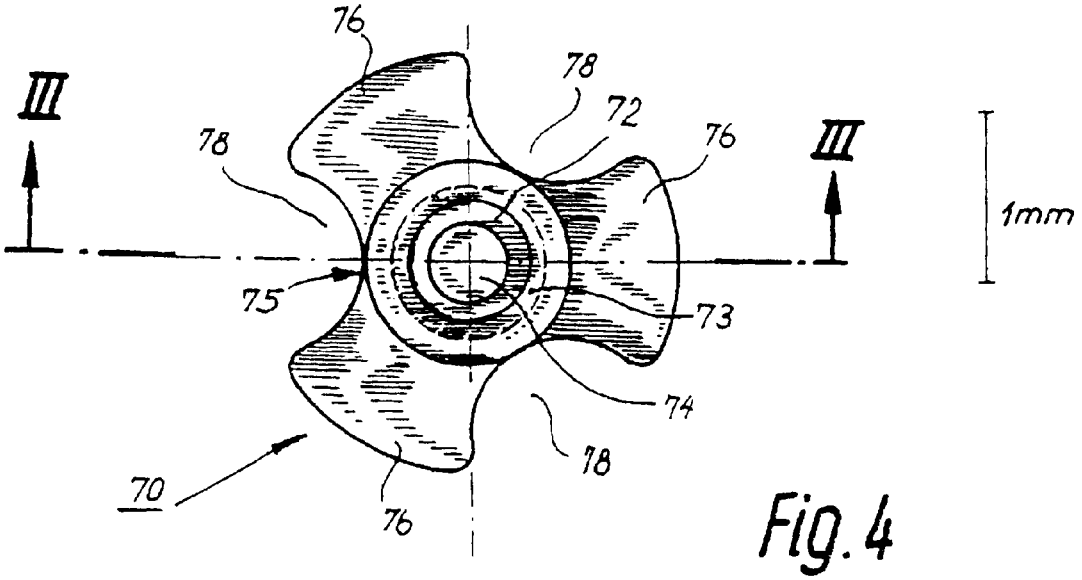
FIG. 4 a plan view from above onto the elastomeric shaped member used in connection with FIGS. 1 through 3, on a greatly enlarged scale.

FIG. 4 shows the elastomeric shaped member 70 in a plan view from above. It has in this embodiment a central part 75 that receives the thrust disc 56. Three tabs 76, spaced at a spacing of 120°, project away from this part 75 like spokes, and hollow spaces 78 are formed between them. The member 70, in a plan view, thus looks like a ship's propeller. The peripheral parts of the tabs 76 are arranged between the ventilator housing 16 and the bottom side of the bearing support tube 26 in the way illustrated. The ventilator housing 16 has for this purpose a recess 80 whose size is matched to that of the shaped member 70. The recess 80 has a central hole 82 at its bottom and three uniformly spaced holes 84 surround it, see FIG. 2. It has been demonstrated that such holes further improve noise damping.

As a material for the shaped member 70 or 170 (FIGS. 8 to 10), the following materials are suitable: MQ=silicone rubber; MFQ=fluoro silicone rubber; NR=natural rubber; NBR=acrylonitrile butadiene rubber; PUR=polyurethane; PUR elastomers. The hardness of the employed polyurethane or other materials is matched to the respective application. The optimal hardness can be determined only by experimentation.

Should the shaft 30, as a result of an impact, hit with its track tip 54 onto the thrust disc 56, first the base 74 is deformed. Subsequently, an inner damping occurs in the material of the shaped member 70, which acts like a buffer, so that the impact is largely absorbed. As a result of the inner damping in the shaped member 70, the vibrations are reduced or transformed into heat. Accordingly, they are conducted only in a greatly weakened form into the ventilator housing 16. Since the latter is substantially comprised of plastic material, it provides an additional damping action. Over all, even for strong vibrations and impacts a clattering of the ventilator 10 is largely prevented in this way.

Figure 9:
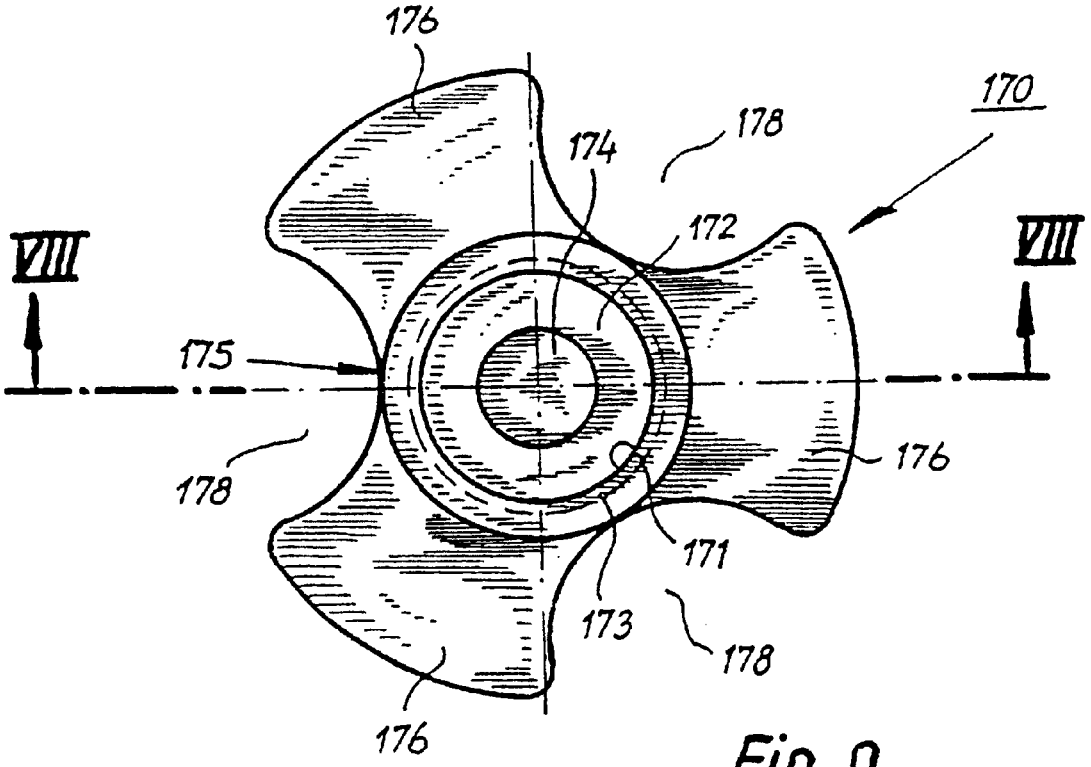
FIG. 9 a plan view viewed in the direction of arrow IX of FIG. 8.

By providing the hollow spaces 80 it is achieved that the material of the shaped member 70, when axially loaded, can laterally yield so that the shaped member 70 acts as a buffer despite its minimal size. Of course, such hollow spaces can have various shapes, and FIGS. 4 and 9 are therefore to be understood only as preferred examples. For example, in some cases it may also be sufficient to use a shaped member 70 without such hollow spaces, i.e., a member with a round, substantially cylindrical shape.

Figure 5:
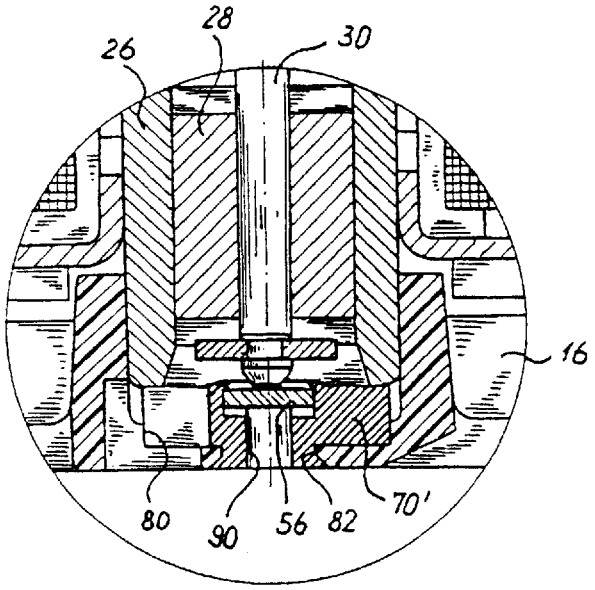
FIG. 5 a first variant of the ventilator of FIGS. 1 through 4.
Figure 6:
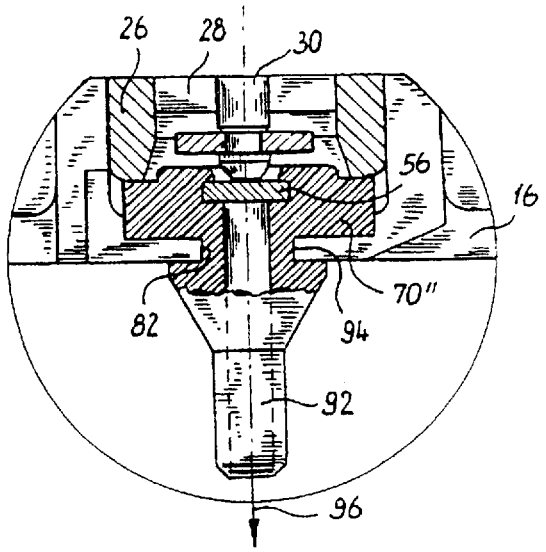
FIG. 6 a second variant of the ventilator of FIGS. 1 through 4.
Figure 7:
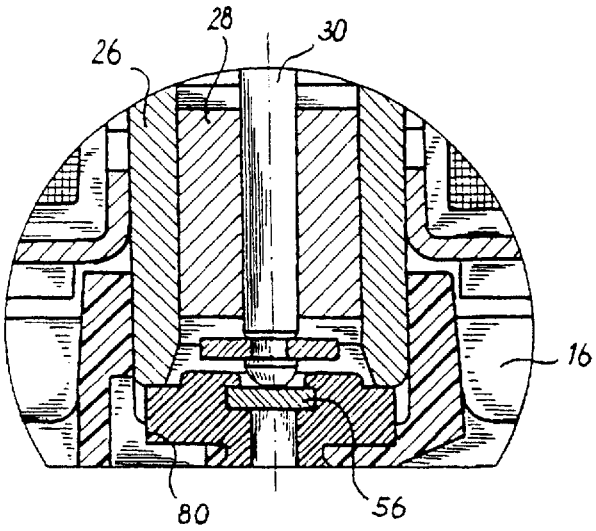
FIG. 7 a third variant of the ventilator of FIGS. 1 through 4.

In the variants of FIGS. 5 to 7, same or same-acting parts have the same reference numerals as used in FIGS. 1 to 4, and the parts are therefore not described anew.

In FIG. 5, a shaped member 70' is injection-molded into the recess 80 and anchored by an undercut at the bottom of the central recess 82. The thrust disc 56 is fastened similarly to the embodiment of FIGS. 1 to 4 but, additionally, a recess 90 is provided underneath it which can further improve the noise damping action.

In FIG. 6, the shaped member 70" has a projection or nipple 92 which during mounting is pulled through a central cutout 82 downwardly in the direction of arrow 96 and is secured by a snap connection by means of its annular groove 94. This enable a very simple automated mounting.

In FIG. 7, the shaped member 70"' is also injection-molded into the recess 80 by means of a multi-component technique.

Figure 8:
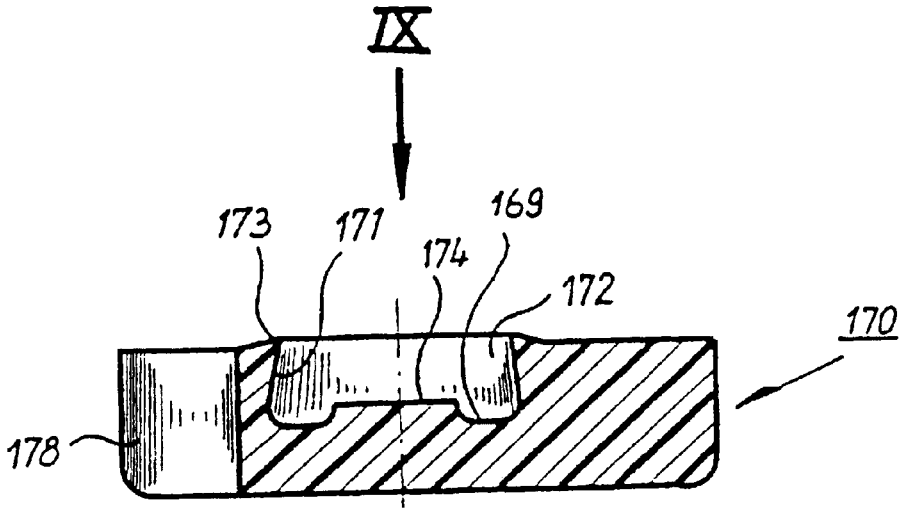
FIG. 8 a section of a fourth variant of the invention, viewed along the line VIII—VIII of FIG. 9.
Figure 10:
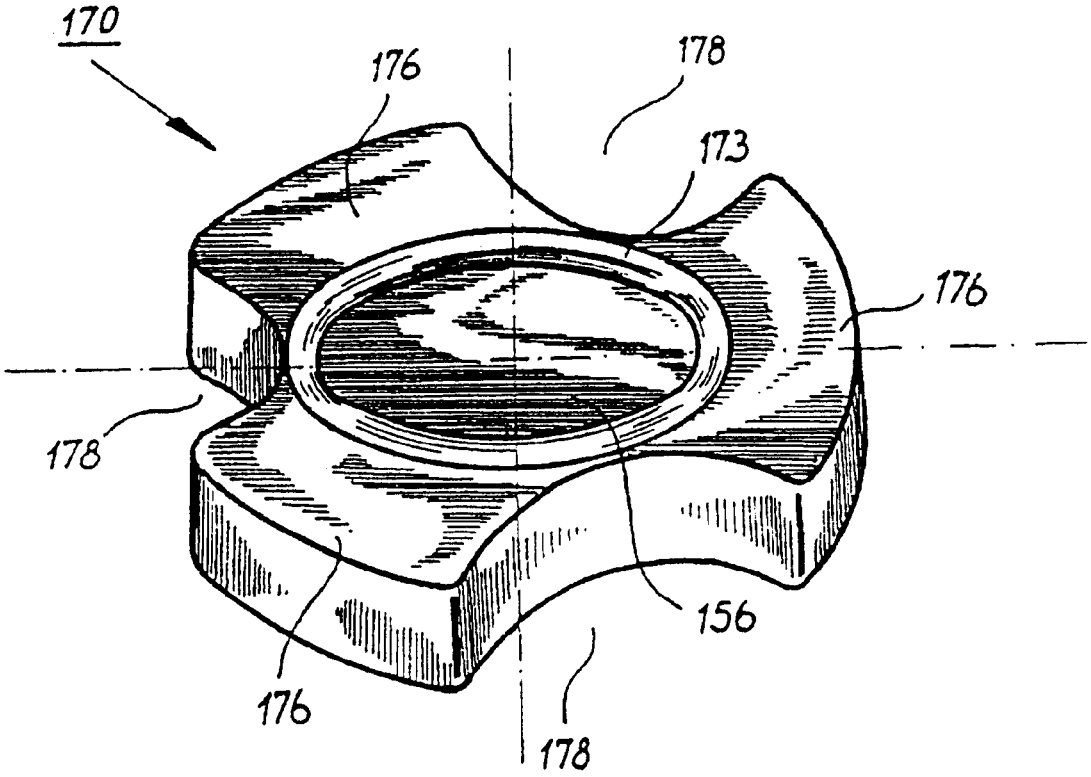
FIG. 10 a perspective illustration of the elastomeric shaped member of FIGS. 8 and 9 with thrust element 156 fastened therein.

In FIGS. 8 to 10, a fourth variant of the invention is illustrated. It employs an elastomeric shaped member 170 which is substantially identical to the shaped member 70 of FIG. 4 and can be used in its place in the motor according to FIGS. 1 to 3. The difference to FIG. 4 is the shaped hollow 172 whose outer circumference 171 tapers from the bottom to the top in the illustrated way so that it is very simple to mount a thrust disc 156 (FIG. 10) in this shaped hollow 172 by automation. At the center of its bottom 169 the shaped hollow 172 has a projection 174 on which, in analogy to FIG. 3, the underside of the thrust disc 156 (FIG. 10) is resting. The upper side of the thrust disc 156 is secured by the upper rim 173 of the shaped hollow 172.

The shaped member 170 has a central part 175 in FIGS. 8 to 10 which receives the thrust disc 156; three parts 176 project away from this central part at a spacing of 120° and between them hollow spaces 178 are located.

The advantage of the fourth variant (FIGS. 8 to 10) is the simpler fastening of the thrust disc 156. The function is identical to that of the previous embodiments.

The outer diameter of the part 170 illustrated in FIG. 9 can be, for example, 5.5 mm.

As a whole, the invention provides a strong noise reduction, in particular, in mobile applications. Preferred is the use of the illustrated sandwich configuration; however, multiple deviations and modifications are possible in the context of the invention.

What is claimed is:

1. An axial fan comprising:

a housing having a bottom part;

an external-rotor drive motor having an external rotor with a rotor shaft and an internal stator, wherein said external rotor is configured to rotate about said internal stator during operation of said external-rotor drive motor;

a fan wheel configured to be driven by said external rotor;

a bearing support tube arranged in said internal stator:

a radial plain bearing arranged in said bearing support tube and supporting said rotor shaft;

an axial bearing formed by a free end of said rotor shaft and a stationary counter member against which said free end of said rotor shaft rests, wherein said stationary counter member comprises a thrust element and an elastomeric shaped member, wherein said thrust element is connected to said elastomeric shaped member;

wherein said elastomeric shaped member is arranged between said bottom part of said housing and said bearing support tube; and wherein said elastomeric shaped member has a projection on a side facing said thrust element and said thrust element is axially supported on said projection, wherein said elastomeric shaped member is configured to be elastically deformable when impacts act on said thrust element in order to absorb, at least partially, the impacts.

2. The axial fan according to claim 1, wherein said elastomeric shaped member comprises a projection having an annular groove and said bottom part of said housing has a cutout, wherein said projection is configured to be pulled through said cutout and to be secured in said cutout by said annular groove engaging said cutout.

3. The axial fan according to claim 1, wherein said housing has a housing recess and wherein said elastomeric shaped member is injection-molded into said housing recess.

4. The axial fan according to claim 3, wherein said housing recess has an undercut configured to anchor said elastomeric shaped member.

5. The axial fan according to claim 1, wherein said elastomeric shaped member has a central part configured to receive said thrust element and further has radial elements connected to said central part and projecting radially away from said central part, wherein said radial elements have outer ends configured to be secured between said bottom part of said housing and said bearing support tube.

6. The axial fan according to claim 1, wherein said elastomeric shaped member comprises a rubber material or polyurethane.

7. The axial fan according to claim 1, wherein said thrust element comprises a polyamide containing friction-reducing additives.

8. The axial fan according to claim 7, wherein said friction-reducing additives comprise molybdenum disulfide.

9. The axial fan according to claim 1, wherein said elastomeric shaped member has a shaped hollow and said thrust element is arranged in said shaped hollow.

10. The axial fan according to claim 9, wherein said shaped hollow has a bottom and an outer periphery tapering in a direction toward said bottom.

11. The axial fan according to claim 1, further comprising:

an external ring and an air guiding ring arranged inside said external ring such that an intermediate space is defined between said external ring and said air guiding ring;

at least one elastic member connecting said external ring and said air guiding ring with one another across said intermediate space and allowing movement between said air guiding ring and said external ring.

12. The axial fan according to claim 11, wherein said external ring has fastening locations and said air guiding ring has fastening locations, wherein said elastic member is a rubber band connected alternatingly and prestressed to said fastening locations on said external ring and said fastening locations on said air guiding ring.

13. The axial fan according to claim 1, wherein said internal stator comprises ferromagnetic material and said external rotor comprises a permanent magnet, wherein said ferromagnetic material and said permanent magnet interact to generate an axial magnetic force, wherein said fan wheel has fan vanes and said fan vanes, during operation of said axial fan, generate a reaction force counteracting said axial magnetic force.

14. The axial fan according to claim 1, wherein said external-rotor drive motor is an electronically commutated motor.

15. The axial fan according to claim 1, wherein said elastomeric shaped member has hollow spaces enabling an elastic deformation of said elastomeric shaped member in the axial direction of said axial fan.

16. The axial fan according to claim 1, wherein said elastomeric shaped member has a central part supporting said thrust element and a plurality of projecting parts connected to said central part and projecting away from said central part, wherein said projecting parts define hollow spaces therebetween and said hollow spaces enable an elastic deformation of said shaped member in the axial direction of said axial fan.

17. The axial fan according to claim 1, wherein said elastomeric shaped member, when viewed in an axial plan view, is propeller-shaped and has propeller vanes, wherein said vanes define hollow spaces therebetween and said hollow spaces enable an elastic deformation of said elastomeric shaped member in the axial direction of said axial fan.

18. The axial fan according to claim 1, wherein said internal stator comprises ferromagnetic material and said external rotor comprises a permanent magnet, wherein said ferromagnetic material and said permanent magnet interact to generate a first, axial force, wherein said free end of said rotor shaft has a track tip loaded by said first axial force in a direction toward said thrust element.

19. The axial fan according to claim 18, wherein said fan wheel has fan vanes directly connected to said external rotor.

20. The axial fan according to claim 19, wherein said fan vanes in operation generate a second axial force counteracting said first axial force, wherein said first axial force is greater than said second axial force.

21. An axial fan comprising:

a housing;

a fan wheel cooperating with said housing;

an external-rotor drive motor arranged in said housing and comprising an internal stator and an external rotor, wherein said fan wheel is arranged on said external rotor;

a bearing support tube and a radial plain bearing arranged in said bearing support tube;

said external rotor having a rotor shaft and said rotor shaft being received in said radial plain bearing;

an axial plain bearing formed by a free end of said rotor shaft and a stationary counter member against which said free end of said rotor shaft rests, wherein said stationary counter member comprises a thrust element and an elastomeric shaped member, wherein said housing has a recess and wherein said elastomeric shaped member is arranged in said recess;

wherein said elastomeric shaped member has a projection on a side facing said thrust element and said thrust element is axially supported on said projection, wherein said elastomeric shaped member is elastically deformable when impacts act on said thrust element.

22. The axial fan according to claim 21, wherein said elastomeric shaped member is arranged at least partially between a part of said housing and said bearing support tube.

23. The axial fan according to claim 22, wherein said elastomeric shaped member comprises a central part and radial elements connected to said central part and projecting radially away from said central part, wherein said radial elements are arranged at least partially between said part of said housing and said bearing support tube, and wherein said thrust element is received in said central part.

24. The axial fan according to claim 23, wherein said radial elements are at least partially clamped between said part of said housing and said bearing support tube.

25. An axial fan comprising a housing;

a fan wheel cooperating with said housing;

an external-rotor drive motor comprising an internal stator, a rotor shaft, and a permanent magnet external rotor supported on one end of said rotor shaft, wherein said fan wheel is arranged on said external rotor and has fan vanes connected directly to said external rotor;

a bearing support tube and a radial plain bearing arranged in said bearing support tube, wherein said rotor shaft is arranged in said radial plain bearing;

wherein said external rotor, in operation, rotates about said internal stator connected to said housing and said bearing support tube;

wherein said internal stator comprises at least one ferromagnetic element;

wherein said rotor shaft has a free end remote from said external rotor;

wherein said permanent magnet external rotor and said at least one ferromagnetic element of said internal stator interact with one another to generate a first axial force acting in a direction toward said free end of said rotor shaft;

an axial bearing formed by said free end of said rotor shaft and a stationary counter member against which said free end of said rotor shaft rests, wherein said stationary counter member comprises a thrust element and an elastomeric shaped member, wherein said elastomeric shaped member has a projection on a side facing said thrust element and said thrust element is axially supported on said projection, wherein said elastomeric shaped member is elastically deformable when impacts act on said thrust element;

wherein said first axial force biases said free end of said rotor shaft toward said thrust element;

wherein said fan wheel, in operation, generates a second axial force counteracting said first axial force, said first axial force being greater than said second axial force, wherein a difference between said first and second axial forces loads said free end of said rotor shaft to contact said thrust element;

wherein said fan housing has a housing recess and wherein said elastomeric shaped member is arranged in said housing recess.

26. The axial fan according to claim 25, wherein said elastomeric shaped member is arranged between a part of said housing and said bearing support tube.

27. The axial fan according to claim 26, wherein said elastomeric shaped member comprises a central part and radial elements connected to said central part and projecting radially from said central part, wherein said radial elements are arranged at least partially between said part of said housing and said bearing support tube, and wherein said thrust element is received in said central part.

28. The axial fan according to claim 27, wherein said radial elements are clamped between said part of said housing and said bearing support tube.

* * * * *